US008113862B2

(12) United States Patent
Wei

(10) Patent No.: US 8,113,862 B2
(45) Date of Patent: Feb. 14, 2012

(54) ACCESSORY PCB FIXTURE AND ELECTRONIC DEVICE EMPLOYING THE SAME

(75) Inventor: Dong Wei, Shenzhen (CN)

(73) Assignees: Ambit Microsystems (Shanghai) Ltd., Shanghai (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 340 days.

(21) Appl. No.: 12/581,230

(22) Filed: Oct. 19, 2009

(65) Prior Publication Data

US 2011/0065291 A1 Mar. 17, 2011

(30) Foreign Application Priority Data

Sep. 11, 2009 (CN) ..... 2009203 1 0163

(51) Int. Cl.
*H01R 13/62* (2006.01)

(52) U.S. Cl. ..... 439/326; 439/328; 439/376

(58) Field of Classification Search ..... 439/326–328, 439/376

See application file for complete search history.

(56) References Cited

U.S. PATENT DOCUMENTS

| | | | | |
|---|---|---|---|---|
| 6,027,357 | A * | 2/2000 | Howell et al. | 439/326 |
| 6,276,951 | B1 * | 8/2001 | Chen et al. | 439/327 |
| 6,666,702 | B1 * | 12/2003 | Pickles | 439/328 |
| 6,923,668 | B2 * | 8/2005 | Tsai | 439/326 |
| 7,467,963 | B2 * | 12/2008 | Chen | 439/328 |

* cited by examiner

*Primary Examiner* — Xuong Chung Trans
(74) *Attorney, Agent, or Firm* — Altis Law Group, Inc.

(57) ABSTRACT

An accessory printed circuit board (PCB) fixture is used in an electronic device to fix an accessory PCB. One end of the accessory PCB electronically connects to an edge connector of a main PCB located in the electronic device. The other end of the accessory PCB defines at least two holes. The accessory PCB fixture includes at least one positioning foot fixed on the main PCB, at least two latch portions and a connecting portion rigidly connecting the positioning foot with the latch portions. The latch portions match the holes of the accessory PCB to fix the accessory PCB. Each latch portion includes a supporting portion, a positioning portion and a hook. One surface of the accessory PCB is supported on the supporting portions. The positioning portions are received in the holes of the accessory PCB. The hooks are latched on the other surface of the accessory PCB.

8 Claims, 6 Drawing Sheets

ACCESSORY PCB FIXTURE AND ELECTRONIC DEVICE EMPLOYING THE SAME

BACKGROUND

1. Technical Field

The present disclosure relates to electronic devices, and in particular to an accessory printed circuit board (PCB) fixture used therein.

2. Description of Related Art

In electronic devices, an edge connector mounted on a main printed circuit board (PCB) provides electronic connection to an accessory PCB. Generally, the accessory PCB electronically connects to the edge connector by insertion thereinto. However, if the accessory PCB is received in the edge connector without any additional securing means, the accessory PCB is easily disengaged from the edge connector during use or transport.

Therefore, a need exists in the industry to overcome the described limitations.

DETAILED DESCRIPTION OF EMBODIMENTS

Figure 1:
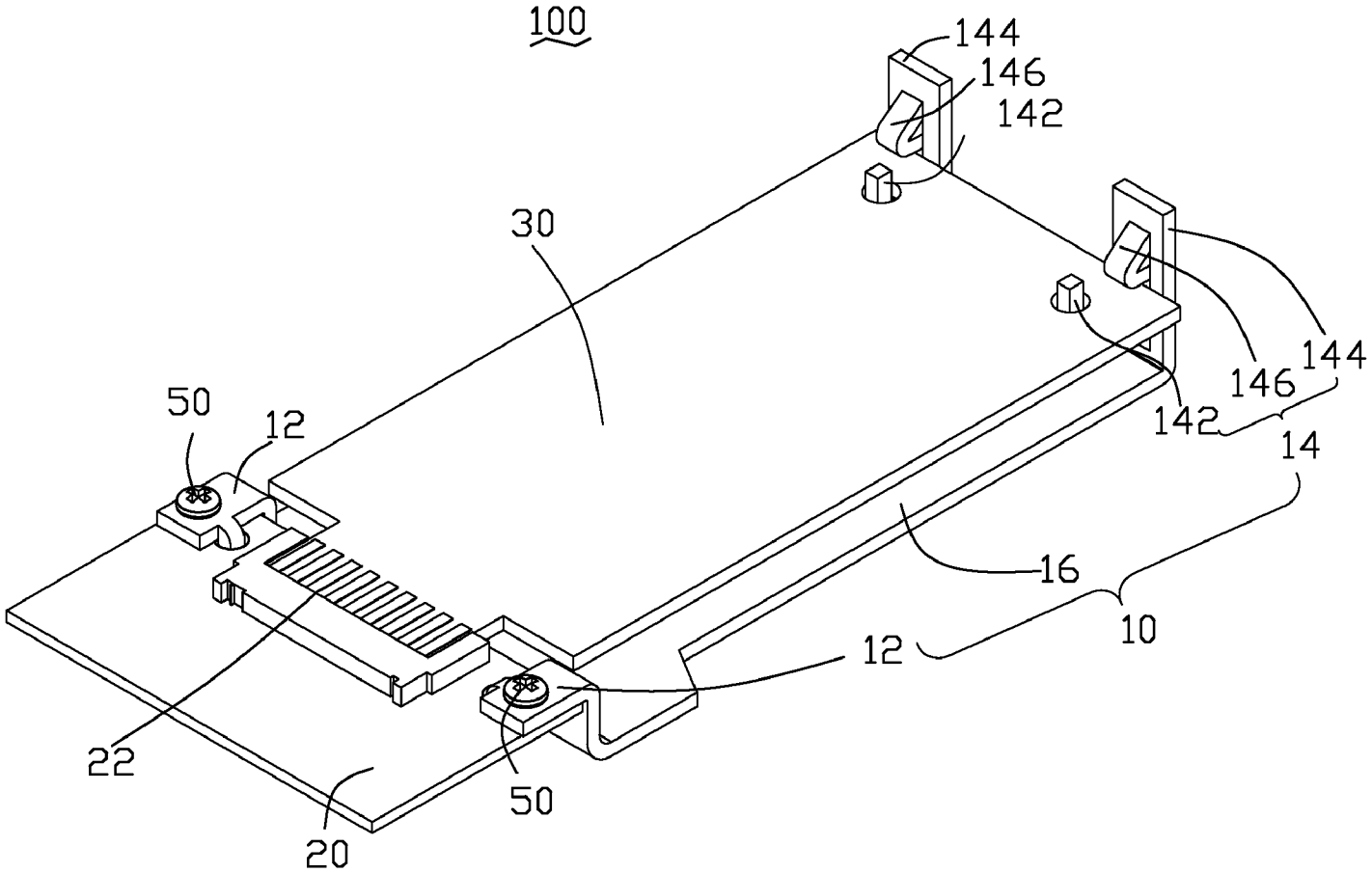
FIG. 1 is a perspective view of an electronic device, including an accessory PCB fixture, in accordance with a first embodiment of the disclosure.
Figure 2:
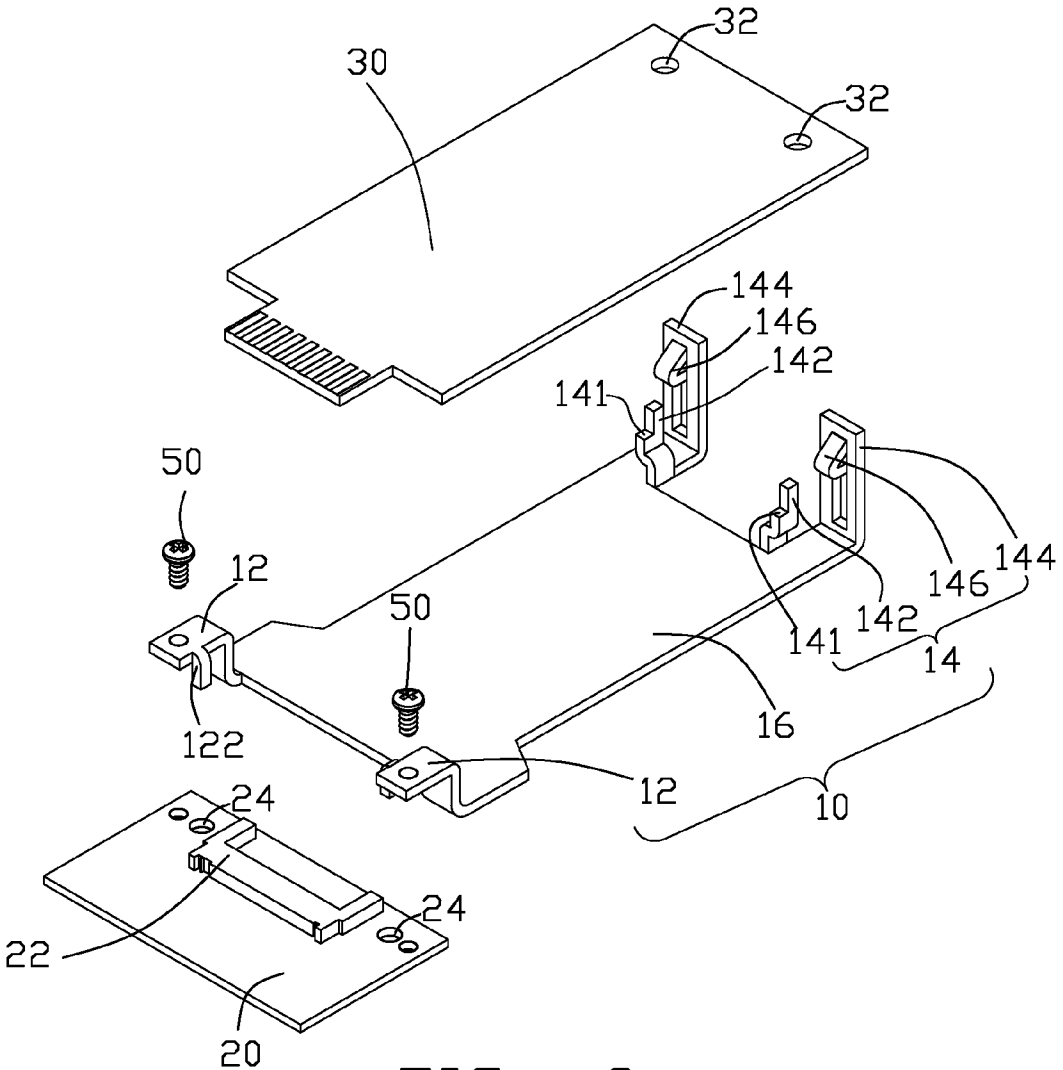
FIG. 2 is an exploded perspective view of FIG. 1.

Referring to FIG. 1 and FIG. 2, an electronic device 100 as disclosed includes an accessory printed circuit board (PCB) fixture 10, a main PCB 20 and an accessory PCB 30 defining at least two holes 32. An edge connector 22 is located on the main PCB 20 to electronically connect the accessory PCB 30. Here, the edge connector 22 is close to an edge of the main PCB 20.

The accessory PCB fixture 10, also disclosed, employed in the electronic device 100, is used to fix the accessory PCB 30. The accessory PCB fixture 10 includes at least one positioning foot 12, at least two latch portions 14 and a connecting portion 16. The at least one positioning foot 12 is fixed on the main PCB 20. The at least two latch portions 14 match the at least two holes 32 of the accessory PCB 30 to fix the accessory PCB 30. The connecting portion 16 rigidly connects the at least one positioning foot 12 with the at least two latch portions 14.

A first embodiment of the electronic device 100 of the disclosure is shown in FIG. 1 and FIG. 2. In this embodiment, the accessory PCB fixture 10 includes two positioning feet 12, fixed to two sides of the edge connector 22. Each positioning foot 12 includes a pin 122. The main PCB 20 defines two positioning holes 24 to receive the pins 122 of the positioning feet 122. The accessory PCB fixture 10 is fixed on the main PCB 20 by the pins 122 being received into the positioning holes 24, and two fasteners 50, such as screws, received in the positioning feet 12 and the main PCB 20. The fasteners 50 and positioning feet 12 cooperatively maintain the position of the accessory PCB fixture 10.

In this embodiment, the accessory PCB 30 defines two holes 32, and the accessory PCB fixture 10 includes two latch portions 14 correspondingly. Each latch portion 14 includes a positioning portion 142, a spring arm 144 and a hook 146. The positioning portions 142 are angled from the connecting portion 16 toward the accessory PCB 30 to be received in the holes 32 of the accessory PCB 30. In the illustrated embodiment, each of the positioning portions 142 includes a supporting portion 141 to support the accessory PCB 30. The spring arms 144 are angled from the connecting portion 16 along the same direction as the positioning portion 142. The hooks 146 are respectively formed on the spring arms 144 and cooperate with the positioning portions 142 to latch the accessory PCB 30.

During installation of the accessory PCB 30 into the edge connector 22 and the accessory PCB fixture 10, one end of the accessory PCB 30 is received in the edge connector 22, and the other end of the accessory PCB 30 lowers such that the positioning portions 142 are received in the holes 32, such that one surface of the accessory PCB 30 is supported on the supporting portions 141, and hooks 146 latched the other surface of the accessory PCB 30. Supporting portions 141 accordingly cooperate with the hooks 146 to latch the accessory PCB 30.

When the accessory PCB 30 is to be removed from the edge connector 22, the two spring arms 144 are withdrawn such that hooks 146 depart from the accessory PCB 30, which can accordingly be removed.

Figure 3:
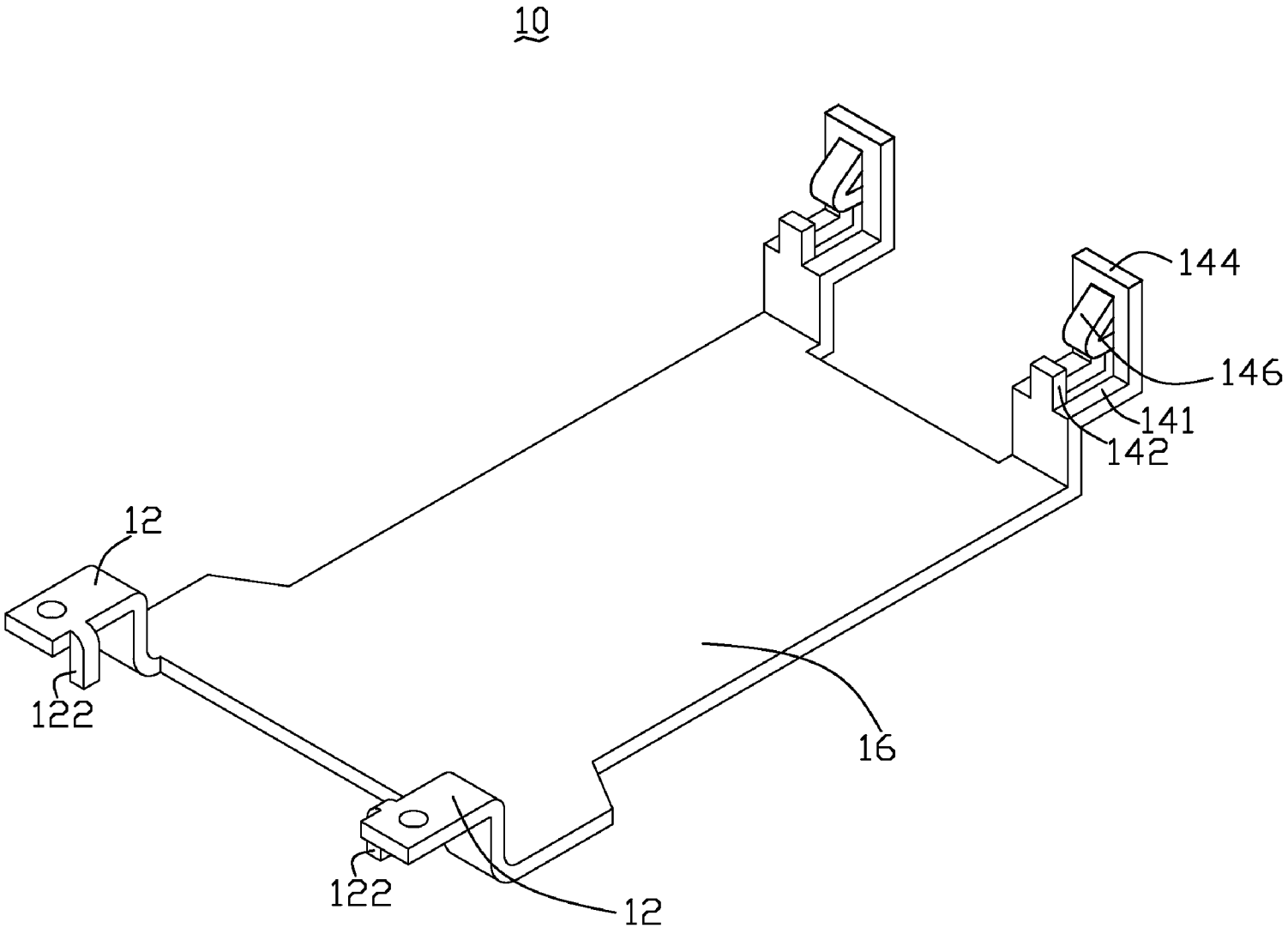
FIG. 3 is a perspective view of an accessory PCB fixture in accordance with a second embodiment of the disclosure.
Figure 4:
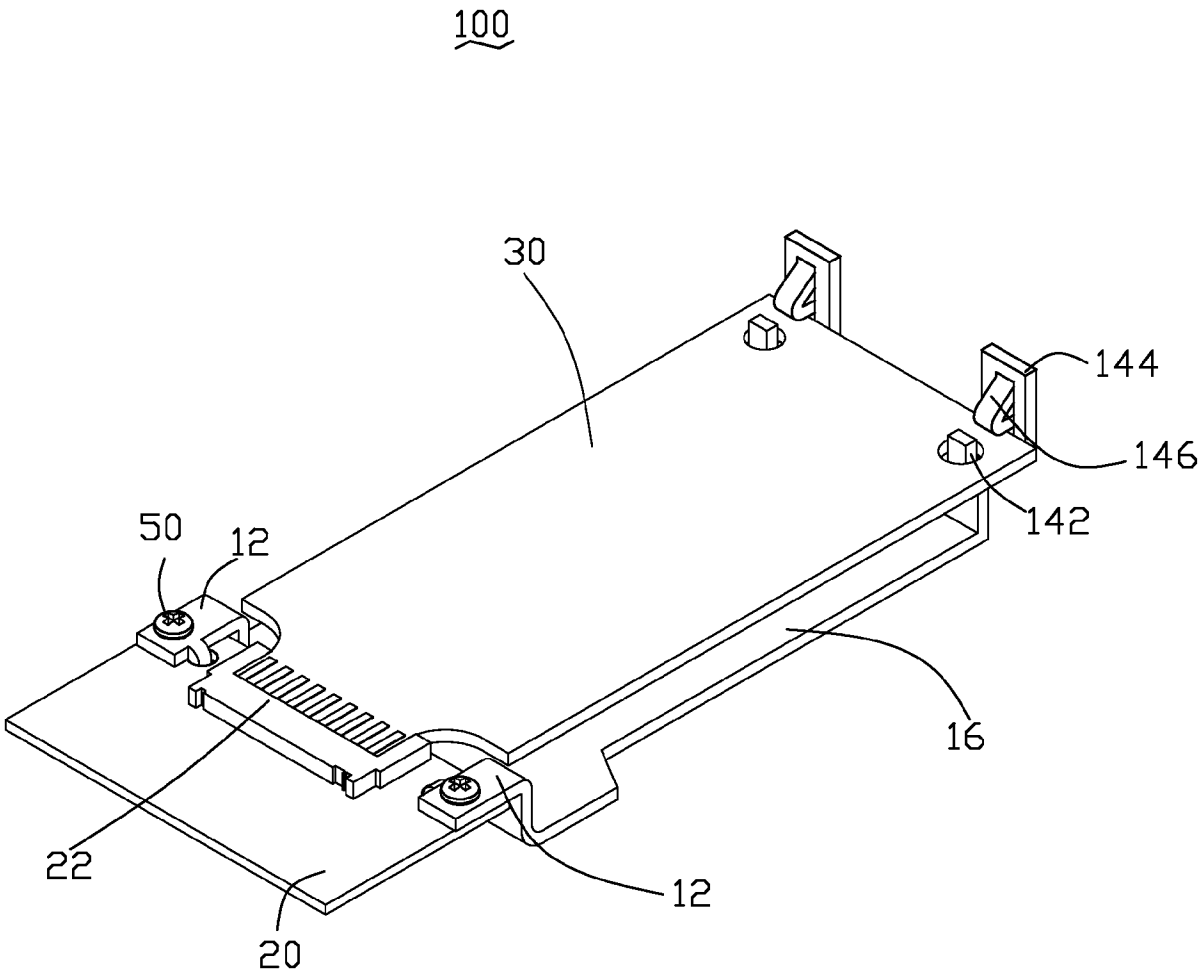
FIG. 4 is a perspective view of an electronic device of the disclosure, including the accessory PCB fixture of FIG. 3.

A second embodiment of the accessory PCB fixture 10 and the electronic device 100 is shown in FIG. 3 and FIG. 4, differing from that of the first embodiment in that accessory PCB fixture 10 of the second embodiment includes two different latch portions 14, and each latch portion 14 includes a supporting portion 141, a positioning portion 142, a spring arm 144 and a hook 146. The supporting portions 141 support the accessory PCB 30 on substantially the same surface as the main PCB 20. The positioning portions 142 are perpendicular to the supporting portions 141, and received in the holes 32 of the accessory PCB 30. The spring arms 144 are angled from one end of the supporting portions 141, and extend towards the accessory PCB 30. The hooks 146 are formed on the spring arms 144 and cooperate with the positioning portions 142 to latch the accessory PCB 30. That is, one surface of the accessory PCB 30 is supported on the supporting portions 142, and the hooks 146 latch the other surface of the accessory PCB 30.

Figure 5:
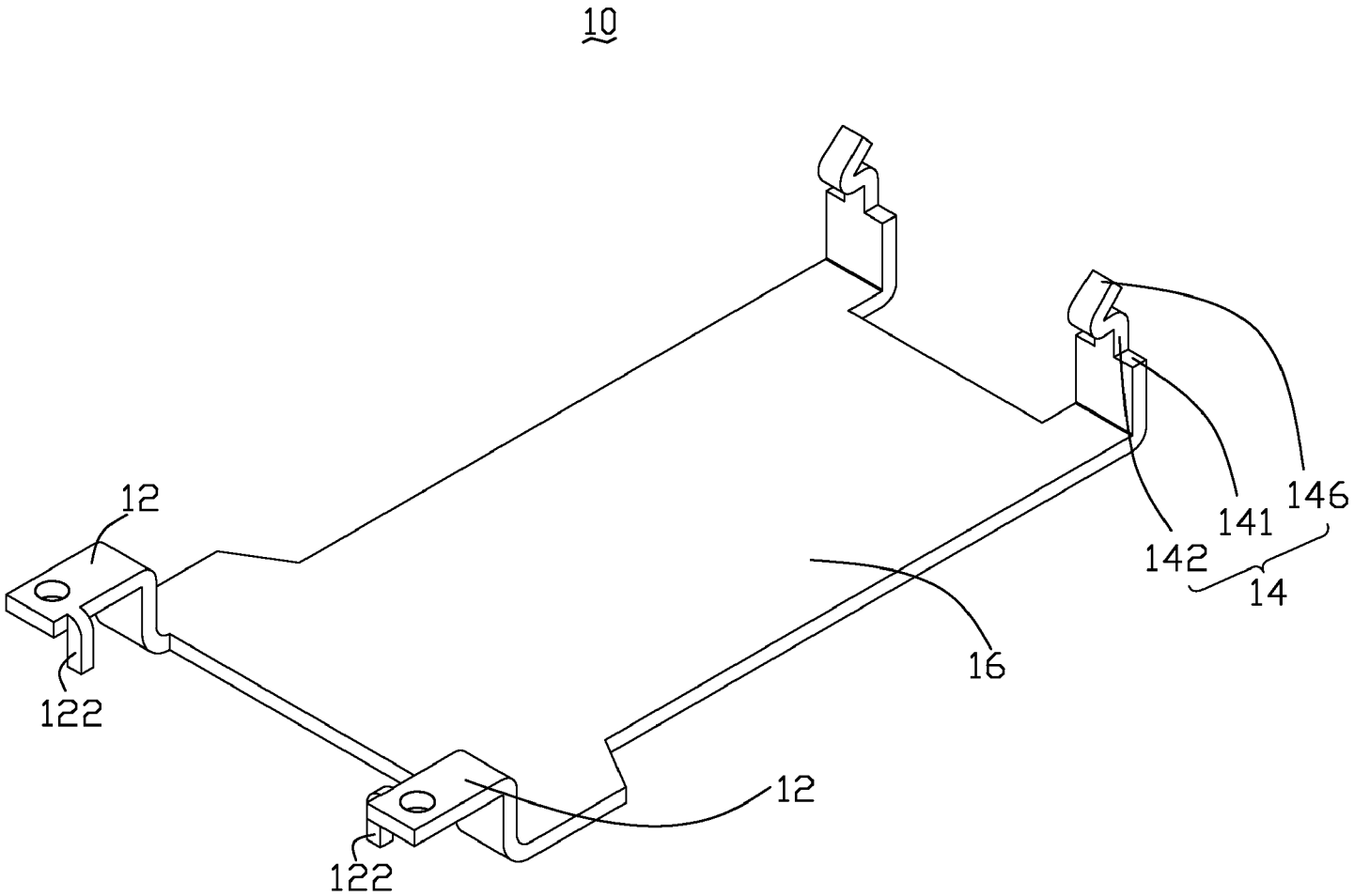
FIG. 5 is a perspective view of an accessory PCB fixture in accordance with a third embodiment of the disclosure.
Figure 6:
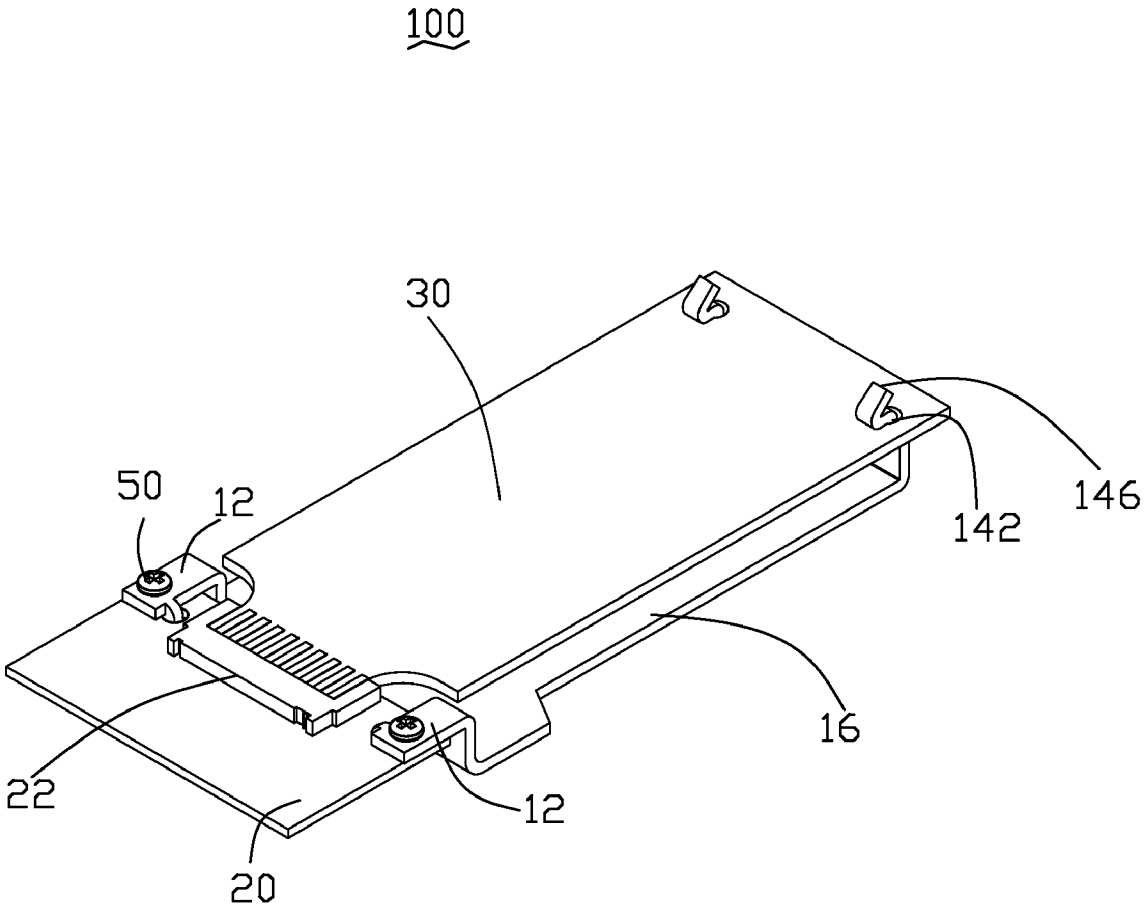
FIG. 6 is a perspective view of an electronic device of the disclosure, including the accessory PCB fixture of FIG. 5.

A third embodiment of the accessory PCB fixture 10 and the electronic device 100 is shown in FIG. 5 and FIG. 6, differing from the first and second embodiments in that each latch portion 14 includes a supporting portion 141, a positioning portion 142 and a hook 146. The supporting portions 141 are angled from the connecting portion 16, and support the accessory PCB 30. The positioning portions 142 extend from the supporting portions 141 toward the accessory PCB 30. Each of the hooks 146 angled from one end of the corresponding positioning portion 142 is flexible, passing through the holes 32 from one surface of the accessory PCB 30 and latch the other surface of the accessory PCB 30.

In the third embodiment, during installation, one end of the accessory PCB 30 is received in the edge connector 22, and the other end of the accessory PCB 30 is lowered such that the hooks 146 and the positioning portions 142 are received in holes 32, such that one surface of the accessory PCB 30 is supported on the supporting portions 141, and the hooks 146 latch the other surface of the accessory PCB 30. Accordingly, the supporting portions 141 cooperate with the hooks 146 to latch the accessory PCB 30. When the accessory PCB 30 is to be removed from the accessory PCB edge connector 22, the accessory PCB 30 is drawn toward the hooks 146, which deform and withdraw from the holes 32 of the accessory PCB 30.

In the embodiments disclosed, the accessory PCB fixture 10 is formed by bending a metal sheet several times. The accessory PCB fixture 10 has a simple structure and mounts the accessory PCB 30 securely.

While exemplary embodiments have been described, it should be understood that they have been presented by way of example only and not by way of limitation. The breadth and scope of the disclosure should not be limited by the described exemplary embodiments, but only in accordance with the following claims and their equivalents.

What is claimed is:

1. An accessory PCB fixture, used in an electronic device to fix an accessory printed circuit board (PCB) to a main PCB, wherein one end of the accessory PCB electronically connects to an edge connector of the main printed circuit board disposed in the electronic device, and the other end of the accessory PCB defines at least two holes, the accessory PCB fixture comprising:

at least one positioning foot, fixed on the main PCB;

at least two latch portions, matching the at least two holes in the accessory PCB to fix the accessory PCB, each of the at least two latch portions comprising a supporting portion, a positioning portion and a hook, wherein one surface of the accessory PCB is supported on the supporting portions, the positioning portions are received in the holes of the accessory PCB, and the hooks are latched on the other surface of the accessory PCB; and a connecting portion, rigidly connecting the at least one positioning foot with the at least two latch portions, wherein each of the latch portions further comprises a spring arm angled from the connecting portion and vertically extending towards the accessory PCB, wherein the positioning portions angle from the connecting portion and extend towards the accessory PCB, and the hooks are respectively formed on the spring arms and cooperate with the positioning portions to latch the accessory PCB.

2. The accessory PCB fixture as claimed in claim 1, wherein the at least one positioning foot comprises a pin received in a positioning hole defined in the main PCB to relatively position the accessory PCB fixture on the main PCB.

3. The accessory PCB fixture as claimed in claim 2, wherein each of the latch portions further comprises a spring arm angled from one end of the supporting portions and vertically extending towards the accessory PCB, the supporting portions are substantially on a same surface as the main PCB, and the hooks are formed on the spring arms and cooperate with the positioning portions to latch the accessory PCB.

4. The accessory PCB fixture as claimed in claim 2, wherein the positioning portions extend from the supporting portions, which are angled from the connecting portion and toward the accessory PCB, and each of the hooks angled from one end of the corresponding positioning portion is flexible so as to pass through the holes from one side of the accessory PCB and latch on the other side of the accessory PCB.

5. An electronic device, comprising:

a main PCB, comprising an edge connector;

an accessory PCB, one end of the accessory PCB electronically connected to the edge connector of the main PCB, and the other end of the accessory PCB defining at least two holes; and an accessory PCB fixture, comprising:

at least one positioning foot, fixed on the main PCB;

at least two latch portions, matching the at least two holes in the accessory PCB to fix the accessory PCB, each of the at least two latch portion comprising a supporting portion, a positioning portion and a hook, wherein one surface of the accessory PCB is supported on the supporting portions, the positioning portions are received in the holes of the accessory PCB, and the hooks are latched on the other surface of the accessory PCB; and a connecting portion, rigidly connecting the at least one positioning foot with the at least two latch portions, wherein each of the latch portions further comprises a spring arm angled from the connecting portion and vertically extending towards the accessory PCB, wherein the positioning portions angle from the connecting portion toward the accessory PCB, and the hooks are respectively formed on the spring arms and cooperate with the positioning portions to latch the accessory PCB.

6. The electronic device as claimed in claim 5, wherein the at least one positioning foot comprises a pin received in a positioning hole defined in the main PCB to relatively position the accessory PCB fixture on the main PCB.

7. The electronic device as claimed in claim 6, wherein each of the latch portion further comprises a spring arm angled from one end of the supporting portions and vertically extending toward the accessory PCB, the supporting portions are substantially on a same surface as the main PCB, and the hooks are formed on the spring arms and cooperate with the positioning portions to latch the accessory PCB.

8. The electronic device as claimed in claim 6, wherein the positioning portions extend from the supporting portions, which are angled from the connecting portion and toward the accessory PCB, and each of the hooks angled from one end of the corresponding positioning portion is flexible so as to pass through the holes from one side of the accessory PCB and latch on the other side of the accessory PCB.

* * * * *